US005245754A

United States Patent [19]

Heintke et al.

[11] Patent Number: 5,245,754

[45] Date of Patent: Sep. 21, 1993

[54] DRY SHAVING APPARATUS

[75] Inventors: Hans-Eberhard Heintke, Wächtersbach; Gerhard Hildebrand, Steinbach; Manfred Ohle, Walldürn; Gunther Seidel, Frankfurt/M.; Klaus Ramspeck; Wolfgang Franke, both of Langen; Reinhold Eichhorn, Idstein-Kröftel; Helmut Dürr, Frankfurt/M.; Gebhard Braun, Kelkheim, all of Fed. Rep. of Germany

[73] Assignee: Braun Aktiengesellschaft, Frankfurt, Fed. Rep. of Germany

[21] Appl. No.: 931,583

[22] Filed: Aug. 18, 1992

[30] Foreign Application Priority Data

Aug. 26, 1991 [DE] Fed. Rep. of Germany ..... 4128220

[51] Int. Cl.[5] ..... B26B 19/02

[52] U.S. Cl. ..... 30/43.92

[58] Field of Search ..... 30/43.3, 43.7, 43.8, 30/43.91, 43.92, 43.98, 43.99

[56] References Cited

U.S. PATENT DOCUMENTS

| | | | |
|---|---|---|---|
| 4,292,737 | 10/1981 | Packham | 30/43.92 |
| 4,796,359 | 1/1989 | Oprach et al. | 30/43.92 |
| 4,797,997 | 1/1989 | Packham | 30/43.92 |
| 4,845,847 | 7/1989 | Yasunaka et al. | 30/43.92 |
| 4,930,217 | 6/1990 | Wolf et al. | 30/43.92 |

FOREIGN PATENT DOCUMENTS

| | | |
|---|---|---|
| 0486903A1 | 5/1992 | European Pat. Off. . |
| 2236276 | 7/1972 | Fed. Rep. of Germany . |
| 3926894C1 | 8/1989 | Fed. Rep. of Germany . |
| 2214124A | 8/1989 | United Kingdom . |

*Primary Examiner*—Frank T. Yost
*Assistant Examiner*—Paul M. Heyrana, Sr.
*Attorney, Agent, or Firm*—Fish & Richardson

[57] ABSTRACT

The invention is directed to a dry shaving apparatus comprising a pair of parallel, elongate shaving heads having inner cutters operatively associated with an outer cutter and arranged on a common coupling member which is coupled to a drive member of an electric drive mechanism, wherein at least one of the inner cutters is movably coupled to the coupling member transversely to the oscillating direction of the inner cutters.

14 Claims, 3 Drawing Sheets

DRY SHAVING APPARATUS

This invention relates to a dry shaving apparatus comprising a pair of parallel, elongate shaving heads whose inner cutters which are operatively associated with an outer cutter are arranged on a common coupling member which is coupled to a drive member of an electric drive mechanism.

A dry shaving apparatus of the type initially referred to is known from DE-C1 39 26 894. The two parallel, elongate inner cutters are resiliently carried in a vertical direction on a common coupling member. The coupling member is comprised of a bottom plate having two cup-shaped receptacles integrally formed thereon and thus defining an invariably uniform relative distance of the two inner cutters, as well as receptacle covers surrounding the receptacles in a cup-shaped manner. The receptacles accommodate each a guide pin and a compression spring for vertically guiding the receptacle covers which are acted upon by the compression springs. The inner cutters are each pivotally secured to the respective upper ends of the receptacle covers by a coupling means and by hinge pins arranged transversely to the longitudinal extent of the inner cutters.

It is an object of the present invention to improve upon the relative cooperation of inner cutters and outer cutter.

According to the present invention, this object is accomplished in that at least one of the inner cutters is movably coupled to the coupling member transversely to the oscillating direction of the inner cutters. The solution of the present invention ensures an improved relative adaptation of the cutter assembly comprising the inner cutters and the outer cutter which are relevant to obtain a good cutting action, thus improving the shaving performance. The movability of at least one of the inner cutters on the coupling member transversely to the oscillating direction facilitates the removal and replacement of a shaving head frame equipped with an outer cutter from and, respectively, on the housing of the shaving apparatus. In addition, by making use of the movability of at least one of the inner cutters, the shaving head frame may be dimensioned to a smaller width in respect of its extent transversely to the oscillating direction of the inner cutters, because following replacement of the shaving head frame on the shaver housing, the inner walls of the shaving head frame and subsequently the outer cutter cause the movable inner cutter or cutters to move automatically into the engagement position with the outer cutter.

In a further feature of the present invention, the coupling member includes a bearing rod which extends transversely to the oscillating direction (S) and has slidably mounted thereon at least one of the inner cutters.

In an embodiment of the present invention, abutment stops for limiting the sliding motion of the inner cutters are provided on the inner cutter and on the coupling member.

In another embodiment of the present invention, one of the inner cutters is fixedly arranged on the coupling member while the second inner cutter is slidably arranged on the bearing rod.

Preferably, the inner cutter is slidably mounted on the bearing rod by means of a sliding element carrying the inner cutter.

In a preferred embodiment of the present invention, the abutment stops are formed by at least one U-shaped recess provided in the coupling member and by engaging holding elements provided on the sliding elements. The formation of cooperating abutment stops by means of a corresponding configuration of the coupling member and the sliding element reduces the manufacturing cost of the coupling member.

Preferably, the bearing rod is secured in at least one wall provided on the coupling member. In an advantageous configuration of this embodiment, the wall serving to secure the bearing rod is provided as an abutment stop for at least one of the slidable inner cutters. In another embodiment of the present invention, the wall is provided for securing one of the inner cutters.

In a further embodiment of the present invention, the inner cutters are of an arcuate configuration.

In a preferred embodiment, the resilient abutting engagement of the inner cutters with the outer cutter is ensured by abutment of a push rod against the coupling member, the push rod being arranged to be slidable against the pressure of a spring. In a further configuration of this embodiment, the push rod and the spring are preferably arranged in the drive member.

In a particularly advantageous embodiment of the present invention, the inner cutters are coupled to the drive member of the electric drive mechanism via the coupling member so as to be pivotal about a pivotal axis. In this embodiment, the pivotal movement of the inner cutters about the pivotal axis Z is accomplished by the action of a pivotally mounted outer cutter on the inner cutters.

Further advantages and details of the present invention will become apparent from the subsequent description and the accompanying drawings illustrating a preferred embodiment. In the drawings, FIG. 1 is a perspective view of a shaving apparatus including a shaving head frame and a pivotally mounted frame member for the outer cutter;

FIG. 1*a* is a perspective view of an outer cutter having two arched shaving surfaces extending parallel to each other;

Figure 1:
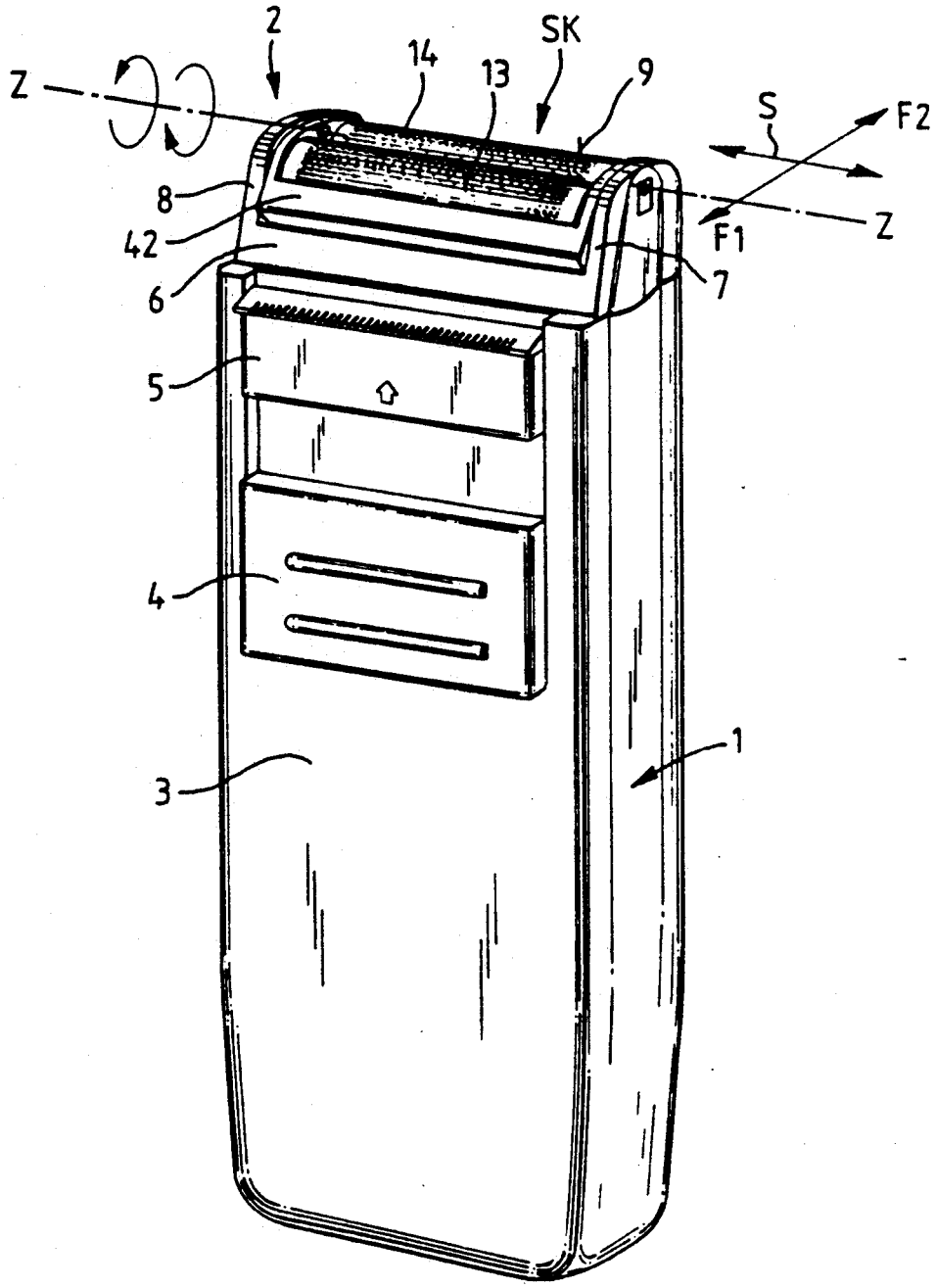

Referring now to FIG. 1 of the drawings, there is shown an electric shaving apparatus having a housing 1 and a shaving head assembly 2 adapted to pivot relative to the housing 1 about a pivotal axis Z, as well as an On-Off switch 4 slidable in the front panel 3 and having associated therewith a slidable long-hair trimmer 5.

Figure 3:
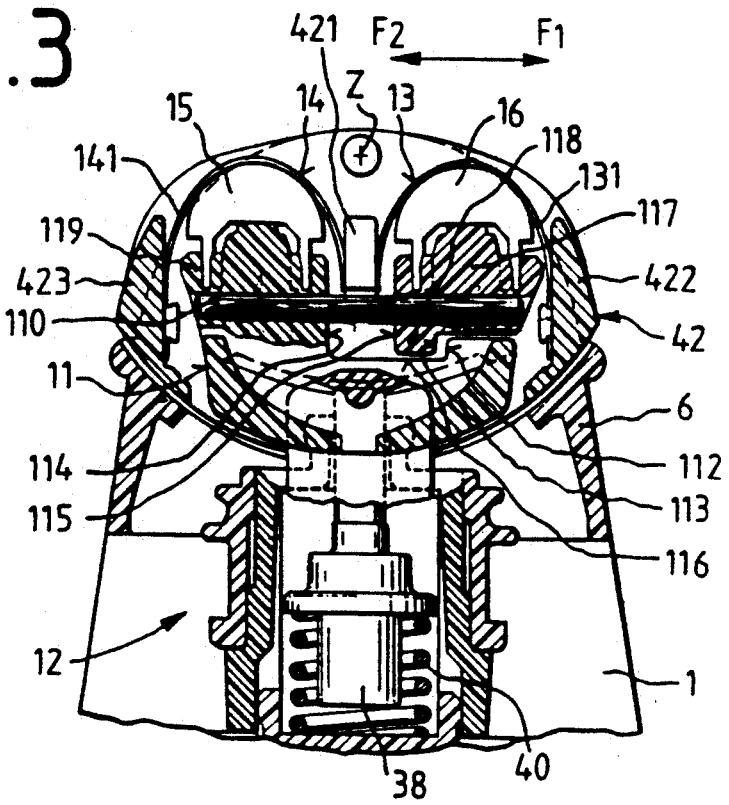
FIG. 3 is a sectional view of a coupling member and a shaving head frame with a pivotally mounted frame member for an outer cutter.

The shaving head assembly 2 including two parallel, elongate shaving heads SK is comprised of a shaving head frame 6 arranged on the housing 1, an outer cutter 9 mounted intermediate end walls 7, 8 so as to be pivotal about the pivotal axis Z, and two inner cutters 15, 16—see FIG. 3—engaging the outer cutter 9 and being coupled to a drive mechanism 12 arranged in the housing 1 by means of a coupling member 11 in both a driving and a pivotal relationship about the pivotal axis Z, with the pivotal movement of the inner cutters 15, 16 being accomplished by the action of the pivotally mounted outer cutter 9 on the inner cutters 15, 16.

Figure 2:
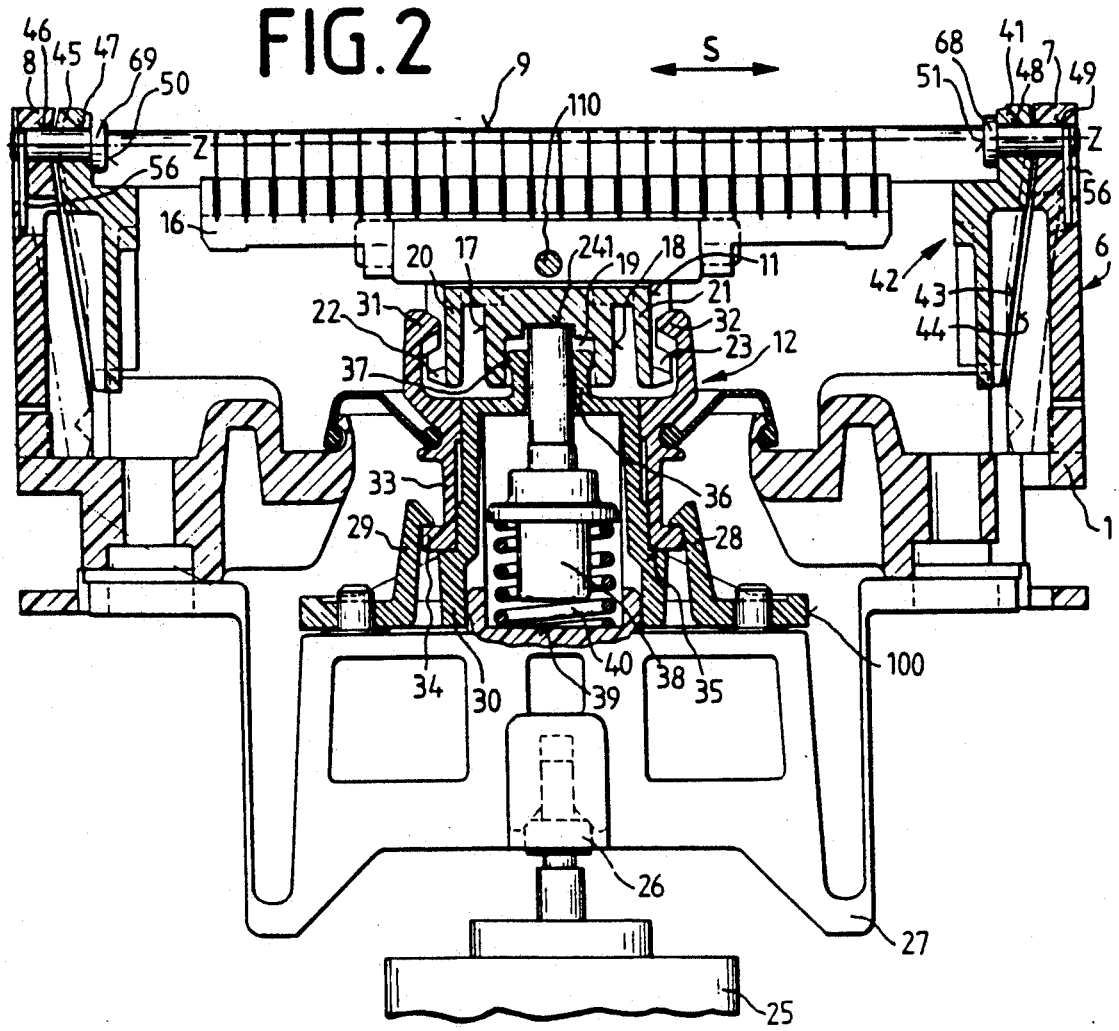
FIG. 2 is a sectional view of a shaving head frame, a frame member for an outer cutter, and a drive mechanism.

The shaving head frame 6 is removably secured to the housing 1 by means of a locking mechanism. As shown in FIG. 2, the frame member 42 for the outer cutter and the shaving head frame 6 are coupled to each other by means of bearing pins 50, 51 extending through respective bearing bores 46, 47 and 48, 49 in respective end walls 8, 45 and 7, 41, and by means of mounting plates 56 serving to secure the bearing pins 50, 51. The center axis of the bearing pins 50, 51 lies on the pivotal axis Z.

Figure 1A:
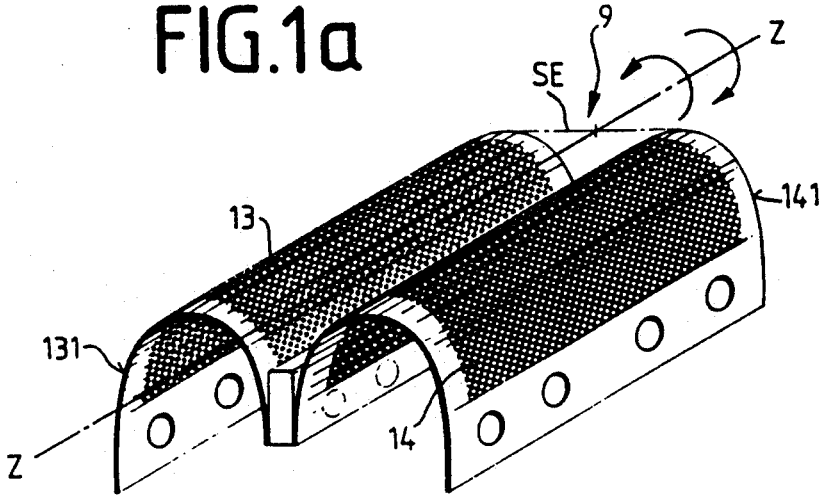

The outer cutter 9 which combines with the inner cutters 15, 16 to form the two shaving heads SK includes two arched shaving surfaces 13, 14 extending parallel to the pivotal axis Z. The tangential plane connecting the arched shaving surfaces 13 and 14 is an imaginary plane referred to as shaving plane SE—see FIG. 1*a*. As becomes apparent from FIG. 3, the shaving surfaces 13 and 14 are formed by two shaving foils 131, 141 attached to the frame member 42 for the outer cutter in arched form. The two shaving foils 131 and 141 are each fastened to a web member 421 provided inside the frame member 42 for the outer cutter and extending parallel to the pivotal axis Z, while their opposed longitudinal sides are coupled to a respective one of the side walls 422, 423 of the frame member 42 for the outer cutter, which side walls extend equally parallel to the pivotal axis.

In an embodiment illustrated in FIG. 3, the inner cutters 15, 16 are comprised of two parallel blade assemblies of arcuate form arranged on the common coupling member 11.

As becomes apparent from FIG. 2, at the end proximate to the drive mechanism 12 the coupling member 11 includes four parallel walls, whereof the opposed inner walls 17 and 18 form a U-shaped recess 19 and the two outer walls 20, 21 are each provided with a respective outwardly extending lug 22, 23. In the U-shaped recess 19, another U-shaped recess 24 is provided, its arcuately extending wall 241 being conformed to the pivotal movement of the outer cutter 9 about the pivotal axis Z.

The drive mechanism 12 is comprised of an oscillating member 27 arranged in the housing 1 and driven by a motor 25 by means of an eccentric member 26, as well as of coupling members mounted on the oscillating member 27, including, for example, a supporting plate 100 having fastening hooks 28, 29 by means of which a drive member 30 and a coupling sleeve 33 having likewise fastening hooks 31, 32 are secured to the supporting plate 100 by engagement with suitable annular shoulders 34, 35. In the embodiment shown, the drive member 30 is comprised of a drive sleeve. At its end proximate to the inner cutters 15, 16, the drive sleeve 30 has a cylindrical cup 36 with an annular outer bead 37 shaped to correspond to a sector of a sphere. With the coupling member 11 coupled to the drive sleeve 30, the outer bead 37 is in abutment with the insides of the inner walls 17 and 18, thus ensuring a transmission of the oscillating movement of the oscillating member 27 to the inner cutters 15, 16 via the coupling member 11 and also a seating of the inner cutters 15, 16 on the drive sleeve 30 in a manner permitting pivotal movements. A push rod 38 extending through the cylindrical cup 36 is arranged in the cup-shaped drive sleeve 30. Seated between the upper side 39 of the oscillating member 27 and the push rod 38 is a spring 40 acting on the push rod 38 to maintain it at all times in engagement with the arcuate contour of the wall 241 of the recess 24 extending concentrically with the pivotal axis Z in the coupling member 11, in order to transmit the force of the spring 40 to the inner cutters 15, 16 for the purpose of resiliently urging the inner cutters 15, 16 into engagement with the outer cutter 9. With its fastening hooks 31, 32, the coupling sleeve 33 surrounding the drive sleeve 30 embraces the lugs 22 and 23 formed on the outer walls 20, 21 of the coupling member 11, and a predetermined flexibility of the fastening hooks 31 and 32 ensures at all times ease of handling, enabling the inner cutters 15, 16 with the coupling member 11 to be readily coupled to, and uncoupled from, the drive mechanism. The fastening hooks 28, 29 are equally of a flexible configuration, thus facilitating the assembly and demounting of push rod 38, spring 40, drive sleeve 30 and coupling sleeve 33 on the oscillating member 27.

FIG. 3 shows a section through a shaving head frame 6 seated on the housing 1, a frame member 42 for an outer cutter, inner cutters 15 and 16, as well as a coupling member 11 and a coupling sleeve 33, the section being taken through the fastening hook 31 of the coupling sleeve 33 and the lug 22 of the coupling member 11. A locking cam 311 is provided on the fastening hook 31. In the assembled condition of housing 1, shaving head frame 6 and frame member 42 for the outer cutter, the locking cam 311 of the fastening hook 31 is at a distance A from and above the lug 22 provided with a control cam 221 and a recess 222. The distance A is adjusted automatically as the shaving head frame 6 is mounted on the housing 1, because during assembly the two inner cutters 15, 16 disposed on the coupling member 11 are moved vertically downwardly by the associated shaving foils 131, 141 in opposition to the pressure of the push rod 38 acted upon by the spring 40.

Figure 3A:
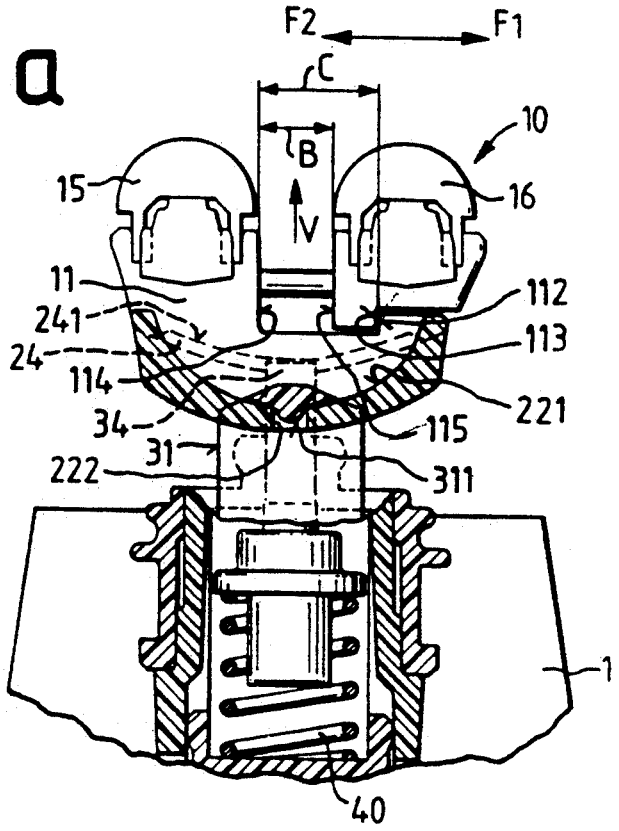
FIG. 3*a* is a sectional view as in FIG. 3 but with the shaving head frame removed.

FIG. 3*a* shows a part section through the shaving apparatus of FIG. 3, illustrating a shaving head frame 6 removed from the housing 1. The removal of the shaving head frame 6 from the housing 1 produces an upward movement, in vertical direction V, of the push rod 38 abutting the wall 241 of the coupling member 11 under the action of the spring 40, until the locking cam 311, after traveling the distance A, engages the control cam 221, which occurs in dependence upon the respective pivot position of the inner cutters 15, 16. Utilizing the resilience of the spring 40, the control cam 221 subsequently slides along the locking cam 311 until the locking cam 311 falls into the recess 222 provided in the control cam 221. In the embodiment shown in FIG. 3*a*, the recess 222 is provided in the center of the arcuate control cam 221, causing, after locking engagement of the locking cam 311 with the recess 222, the blade assembly 10 to assume a centered position lying in the middle of the predetermined pivot range of the blade assembly 10 pivotal in clockwise and counterclockwise direction. It will be understood that a control cam, not shown, having a prismatic control area whose prismatic surfaces terminate in a recess may be substituted for the arcuate control cam 221.

The lug 23 of the coupling member 11 and the second fastening hook 32 provided on the coupling sleeve 33 are configured in accordance with the lug 22 and the fastening hook 31 previously described and are disposed in a 180-degree offset relation thereto.

The movement and the locking engagement of the inner cutters 15, 16 in the centered position shown which occur automatically on removal of the shaving head frame 6 from the housing 1 under the pressure of the spring 40 acting on the push rod 38 permit ease of cleaning of the inner cutters 15, 16 coupled to the drive mechanism as well as ready seating of the shaving head frame 6 equipped with a pivotally carried outer cutter 9 on the housing 1.

By placing the shaving head frame 6 down onto the housing 1, the outer cutter 9 acts on the inner cutters 15, 16 with the coupling member 11 and on the push rod 38, thereby urging the parts vertically downwardly against the pressure of the spring 40, as a result of which the locking engagement obtained by the locking cams 311, the fastening hooks 31 and 32 and the recesses 222 in the control cams 221 is automatically canceled, as illustrated in FIG. 3. In this condition, the inner cutters 15, 16, in combination with the outer cutter 9, are free to pivot about the pivotal axis Z.

Details regarding the arrangement of the inner cutters 15, 16 on the coupling member 11 being illustrated in FIGS. 2, 3 and 3*a*, they will be explained in more detail in the following. A bearing rod 110 extending transversely to the oscillating direction S of the inner cutters 15, 16 or transversely to the direction of the pivotal axis Z is secured to the wall 119 of the coupling member 11. The bearing rod 110 carries the inner cutter 16 enabling it to reciprocate in the directions of arrows F1 or F2, with a sliding element 117 slidable on the bearing rod 110 being arranged between a carrier structure carrying the blades of the inner cutter and the coupling member 11. Provided on the sliding element 117 is a downwardly extending holding element 118 protruding into a U-shaped recess 116 in the coupling member 11. The side walls of the holding element 118 protruding into the recess 116 serve as abutment stops 113 and 115 for limiting the length of sliding travel of the inner cutter 16 on the bearing rod 110. The length of sliding travel of the inner cutter 16 on the bearing rod 110 in the direction of arrows Fl or F2 is limited by the respective abutment stops 112 and 114 which in the embodiment shown are formed by the side walls of the U-shaped recess 116.

As becomes apparent from FIG. 3*a*, with the shaving head frame 6 detached from the housing 1 and the abutment stop 113 resting against the abutment stop 112, the inner cutter 16 is movable relative to the bearing rod 110 in the direction indicated by the arrows by an amount corresponding to the relative distance B of the abutment stops 114 and 115. The relative distance C of the abutment stops 114 and 112 is dimensioned such that, with the shaving head frame 6 seated on the housing 1 as shown in FIG. 3, a gap is maintained between the abutment stops 113 and 112. Owing to the movable arrangement of the inner cutter 16 on the bearing rod 110, such a dimensioning of the distance C makes sure that the inner cutter 16 conforms optimally to the shaving foil 131 of the outer cutter 9.

In a further embodiment not shown, both inner cutters 15, 16 are arranged on the bearing rod 110 so as to be slidable in the directions of arrows F1 and F2. In such an embodiment, the bearing rod 110 may be secured, for example, to a wall provided on the coupling member 11 between the inner cutters 15 and 16, and the abutment stops limiting the sliding motion of the inner cutters 15 and 16 are provided by holding elements integrally formed on the sliding elements of the inner cutters and by the side walls of U-shaped recesses provided in the coupling member on either side of the wall carrying the bearing rod.

In still another embodiment not shown, the shaving head frame 6 detachably coupled to the housing 1 is equipped with an outer cutter 9 forming two shaving heads SK and immovably mounted in the shaving head frame. Accordingly, the two inner cutters are coupled to the drive member 30 of the drive mechanism 12 via the coupling member 11 only for the purpose of transmitting the oscillating movement S, all structural means serving to transmit a pivotal motion of outer and inner cutter about the pivotal axis Z being then omitted. Mounted on the coupling member 11 is at least one of the inner cutters 15, 16 which is movable on a sliding rod in the directions of arrows F1 or F2, as previously described.

We claim:

1. A dry shaving apparatus comprising an electric drive mechanism, a drive member coupled to said electric drive mechanism, common coupling structure coupled to said drive member, a pair of parallel, elongate shaving heads (SK) comprising outer cutter structure and a pair of inner cutters operatively associated with said outer cutter structure and arranged on said coupling structure for oscillating movement as driven by said drive mechanism, at least one of said inner cutters being coupled to said coupling structure for movement towards and away from the other inner cutter in a sideways direction transversely to the oscillating direction of said inner cutters.

2. The dry shaving apparatus of claim 1 wherein said coupling structure includes a bearing rod which extends transversely to said oscillating direction (S) and has slidably mounted thereon said one inner cutters.

3. The dry shaving apparatus of claim 1 or 2 and further including abutment stop structure on said one inner cutter and on said coupling structure for limiting the transverse sideways movement of said one inner cutter.

4. The dry shaving apparatus of claim 2 wherein a first of said inner cutters is fixedly arranged on said coupling structure while a second said inner cutter is slidably arranged for sideways movement on said bearing rod.

5. The dry shaving apparatus of claim 4 wherein said second inner cutter is slidably mounted on said bearing rod by means of a sliding element carrying said second inner cutter.

6. The dry shaving apparatus of claim 5 and further including abutment stop structure formed by at least one U-shaped recess provided in said coupling structure and by cooperative holding structure on said sliding element.

7. The dry shaving apparatus of claim 4 wherein said coupling structure includes wall structure and said bearing rod is secured in said wall structure.

8. The dry shaving apparatus of claim 7 wherein said wall structure serving to secure said bearing rod provides an abutment stop for said one inner cutter.

9. The dry shaving apparatus of claim 8 wherein one of said inner cutters is fixedly secured on said wall structure.

10. The dry shaving apparatus of claim 1 or 2 wherein each of said inner cutters is of an arcuate configuration.

11. The dry shaving apparatus of claim 1 or 2 and further including push rod structure and spring structure, said push rod structure being arranged to be slidable against the pressure of said spring structure, said inner cutters being urged into resilient abutting engagement with said outer cutter structure by abutment of said push rod structure against said coupling structure.

12. The dry shaving apparatus of claim wherein said push rod structure and said spring structure are arranged in said drive member.

13. The dry shaving apparatus of claim 1 or 2 wherein said inner cutters are coupled to said drive member of said electric drive mechanism via said coupling member so as to be pivotal about a pivotal axis (Z).

14. The dry shaving apparatus of claim 13 wherein said outer cutter structure is pivotally mounted and the pivotal movement of said inner cutters about said pivotal axis (Z) is accomplished by the action of said pivotally mounted outer cutter structure on said inner cutters.

* * * * *